US010667063B2

(12) United States Patent
Hui et al.

(10) Patent No.: US 10,667,063 B2
(45) Date of Patent: May 26, 2020

(54) SOUND LEVEL CONTROL FOR HEARING ASSISTIVE DEVICES

(71) Applicant: BITwave Pte Ltd, Singapore (SG)

(72) Inventors: Siew Kok Hui, Singapore (SG); Lei Tu, Singapore (SG)

(73) Assignee: BITWAVE PTE LTD, Singapore (SG)

( * ) Notice: Subject to any disclaimer, the term of this patent is extended or adjusted under 35 U.S.C. 154(b) by 0 days.

(21) Appl. No.: 15/886,078

(22) Filed: Feb. 1, 2018

(65) Prior Publication Data

US 2018/0160239 A1 Jun. 7, 2018

Related U.S. Application Data

(62) Division of application No. 15/097,011, filed on Apr. 12, 2016, now abandoned.

(60) Provisional application No. 62/278,425, filed on Jan. 13, 2016, provisional application No. 62/218,543, filed on Sep. 14, 2015.

(51) Int. Cl.
*H04R 25/00* (2006.01)

(52) U.S. Cl.
CPC ..... *H04R 25/505* (2013.01); *H04R 25/356* (2013.01); *H04R 25/453* (2013.01); *H04R 25/70* (2013.01); *H04R 2225/61* (2013.01); *H04R 2430/01* (2013.01)

(58) Field of Classification Search
CPC .... H04R 25/505; H04R 25/70; H04R 25/453; H04R 25/356; H04R 2225/61; H04R 2430/01
USPC ..... 381/320, 151, 315; 704/208, 231, 233, 704/246
See application file for complete search history.

(56) References Cited

U.S. PATENT DOCUMENTS

| | | | | |
|---|---|---|---|---|
| 4,088,835 | A | 5/1978 | Thurmond et al. | |
| 5,822,726 | A | 10/1998 | Taylor et al. | |
| 8,103,019 | B1 * | 1/2012 | Pandey | H04R 3/02 381/93 |
| 2002/0052561 | A1 | 5/2002 | Thornton | |

(Continued)

FOREIGN PATENT DOCUMENTS

| | | |
|---|---|---|
| EP | 1471765 | 10/2004 |
| EP | 2677770 | 12/2013 |

(Continued)

OTHER PUBLICATIONS

Notice of Allowance received for U.S. Appl. No. 15/351,742 dated Oct. 4, 2018, 20 pages.
European Office Action dated Dec. 20, 2018 for European Application No. 162018873. 8 pages.

(Continued)

*Primary Examiner* — Sunita Joshi
(74) *Attorney, Agent, or Firm* — Amin, Turocy & Watson, LLP

(57) ABSTRACT

For many hearing assistive devices, the user's speech is received at a larger amplitude signal than the speech of someone speaking to the user. Since the user's speech is also picked up by the microphone and feed through the speaker causing an acoustic feedback effect, the user may have to constantly adjust the volume of the hearing assistive device to achieve a more comfortable volume based on where the speech is coming from. Therefore, mitigating the acoustic feedback effect of assistive hearing devices can generate a more efficient and comfortable hearing device.

20 Claims, 11 Drawing Sheets

(56) References Cited

U.S. PATENT DOCUMENTS

| | | | | |
|---|---|---|---|---|
| 2004/0015352 | A1* | 1/2004 | Ramakrishnan | G10L 25/78 704/240 |
| 2005/0111683 | A1 | 5/2005 | Chabries et al. | |
| 2007/0009122 | A1* | 1/2007 | Hamacher | H04R 25/453 381/312 |
| 2008/0123883 | A1* | 5/2008 | Blamey | H03G 9/005 381/312 |
| 2008/0235011 | A1* | 9/2008 | Archibald | G10L 25/78 704/225 |
| 2010/0004766 | A1* | 1/2010 | Feng | G10H 1/46 700/94 |
| 2010/0027820 | A1* | 2/2010 | Kates | G10L 25/00 381/312 |
| 2010/0184488 | A1 | 7/2010 | Takada | |
| 2011/0019839 | A1 | 1/2011 | Nandury | |
| 2015/0124998 | A1 | 5/2015 | Siegel et al. | |
| 2015/0302869 | A1* | 10/2015 | Tomlin | G10L 25/78 704/246 |
| 2016/0014532 | A1* | 1/2016 | Nielsen | H04R 25/505 381/60 |
| 2016/0373573 | A1* | 12/2016 | Bivens | H04M 3/02 |

FOREIGN PATENT DOCUMENTS

| | | |
|---|---|---|
| EP | 2736271 | 5/2014 |
| JP | H08179794 | 7/1996 |

OTHER PUBLICATIONS

Non-Final Office Action received for U.S. Appl. No. 15/351,742 dated May 31, 2018, 28 pages.

Partial European Search Report dated Feb. 3, 2017 for European Patent Application No. 16184238.0, 7 pages.

Extended European Search Report dated May 9, 2017 for European Patent Application No. 16184238.0, 23 pages.

Extended European Search Report dated May 19, 2017 for European Patent Application No. 16201887.3, 9 pages.

Non-Final Office Action dated Nov. 1, 2017 for U.S. Appl. No. 15/097,011, 33 pages.

European Office Action dated Dec. 20, 2017 for European Application No. 16184238.0, 6 pages.

Communication pursuant to Article 94(3) EPC received for EP Application No. 16201887.3 dated Oct. 2, 2019, 5 pages.

* cited by examiner

SOUND LEVEL CONTROL FOR HEARING ASSISTIVE DEVICES

CROSS-REFERENCE TO RELATED APPLICATIONS

This patent application is a divisional application of, and claims priority to each of, U.S. Non-provisional patent application Ser. No. 15/097,011, filed on Apr. 12, 2016, and entitled "SOUND LEVEL CONTROL FOR HEARING ASSISTIVE DEVICES", which application claims priority to each of U.S. Provisional Patent Application No. 62/278,425, filed on Jan. 13, 2016, and entitled "HEARING ASSISTIVE DEVICE WITH NEAR-END SOUND LEVEL CONTROL AND HOWLING CONTROL", and U.S. Provisional Patent Application No. 62/218,543, filed Sep. 14, 2015, and entitled "HEARING ASSISTIVE DEVICE WITH NEAR-END SOUND LEVEL CONTROL AND HOWLING CONTROL". The entireties of the foregoing applications are hereby incorporated by reference herein.

TECHNICAL FIELD

This disclosure relates generally to hearing assistive devices. More specifically, this disclosure relates to generating sound level control for with hearing assistive devices.

BACKGROUND

A hearing aid or deaf aid is an electroacoustic device, which is designed to amplify sound for a user, usually with the aim of making speech more intelligible, and to correct impaired hearing as measured by audiometry. In the United States, hearing aids are considered medical devices and are regulated by the Food and Drug Administration (FDA). Therefore, ordinary small audio amplifiers or other plain sound reinforcing systems cannot be sold as "hearing aids".

Earlier devices, known as ear trumpets or ear horns, were passive funnel-like amplification cones designed to gather sound energy and direct it into the ear canal. Similar devices can include the bone anchored hearing aid, and cochlear implant. A primary issue that can minimize the effectiveness of hearing aids is called the compression effect. The compression effect takes place when the amplification needed to make quiet sounds audible, if applied to loud sounds, damages the inner ear (cochlea). Louder sounds are therefore reduced giving a smaller audible volume range and hence inherent distortion. However, hearing protection can also be provided by an overall cap to the sound pressure and impulse noise suppression, which is available in some high-end hearing aids.

The above-described background relating to hearing aids is merely intended to provide a contextual overview of hearing aid technology, and is not intended to be exhaustive. Other context regarding hearing aids may become further apparent upon review of the following detailed description.

BRIEF DESCRIPTION OF THE DRAWINGS

Non-limiting and non-exhaustive embodiments of the subject disclosure are described with reference to the following figures, wherein like reference numerals refer to like parts throughout the various views unless otherwise specified.

DETAILED DESCRIPTION

Figure 1:
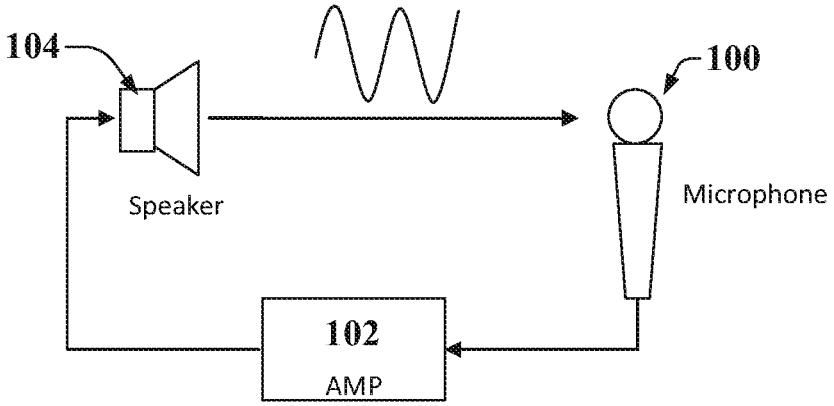
FIG. 1 illustrates an example schematic of an assistive hearing device.

In the following description, numerous specific details are set forth to provide a thorough understanding of various embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in one or more embodiments.

As utilized herein, terms "component," "system," "interface," and the like are intended to refer to a computer-related entity, hardware, software (e.g., in execution), and/or firmware. For example, a component can be a processor, a process running on a processor, an object, an executable, a program, a storage device, and/or a computer. By way of illustration, an application running on a server and the server can be a component. One or more components can reside within a process, and a component can be localized on one computer and/or distributed between two or more computers.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

The words "exemplary" and/or "demonstrative" are used herein to mean serving as an example, instance, or illustration. For the avoidance of doubt, the subject matter disclosed herein is not limited by such examples. In addition, any aspect or design described herein as "exemplary" and/or "demonstrative" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, such terms are intended to be inclusive—in a manner similar to the term "comprising" as an open transition word—without precluding any additional or other elements.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

In addition, the disclosed subject matter can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, computer-readable carrier, or computer-readable media. For example, computer-readable media can include, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media.

As an overview of the various embodiments presented herein, to correct for the above identified deficiencies and other drawbacks of hearing aid devices, various embodiments are described herein to facilitate the reduction of feedback related to hearing aid device.

A simplified overview is provided herein to help enable a basic or general understanding of various aspects of exemplary, non-limiting embodiments that follow in the more detailed description and the accompanying drawings. This overview is not intended, however, as an extensive or exhaustive overview. Instead, the purpose of this overview is to present some concepts related to some exemplary non-limiting embodiments in simplified form as a prelude to more detailed descriptions of the various embodiments that follow in the disclosure.

Described herein are systems, methods, articles of manufacture, and other embodiments or implementations that can facilitate the use of hearing aid devices. A variety of hearing aid devices suffer from acoustic feedback. However, the embodiments of the hearing aid device presented herein provide several advantages such as a reduced acoustic feedback and user comfort.

The absolute amplitude or the strength of an acoustic signal such as speech can depend on the distance between the source and the microphone. In a hearing assistive device or a hearing aid device, a microphone can be close to a user's mouth, but the sound sources of interest can be far from the microphone. In a typical scenario, the distance between the sources (i.e.: far-end talkers) and the microphone can range from one meter to three meters (or further), during a typical conversation. When the distance between the sound source and the microphone is very far, the amplitude capture by the microphone is expected to be very small due to propagation loss of the sound energy. When the distance between the microphone and the sound source is very near, the amplitude of the speech signal captured by the microphone will be very large. In order for the sources and the user to communicate, the device can amplify a signal from the source to a level perceptible by the user. However, when it is the user's turn to talk, the signal captured by the device's microphone can be large due to the amplification. So the user can perceive his/her own voice to be very loud and will be very uncomfortable to his/her auditory system. However if the user set his/her microphones sensitivity too low, then he/she can have problem hearing the far-end talker clearly. Therefore, the signal can be too loud for the user's ear and will cause discomfort to the user's auditory system.

A simple personal amplifier system can comprise a microphone, an amplifier, and one or more speakers. Whenever the aforementioned components are present, there is a potential for feedback. Feedback occurs when the sound from the speakers makes it back into the microphone and is re-amplified and sent through the speakers again. This loop happens so quickly that it can create its own frequency, which is heard as a howling sound. The howling sound can generally be a sinusoidal wave tone, and the distance between the microphone and the speakers can determine the frequency of the howling. The distance can control how quickly the sound can loop through the system. After repeatedly being amplified, the howling sound can be so loud that it irritates or damage one's hearing. Moreover, when the amplification gain is high in a hearing aid device, the howling sound can be very common. Therefore, an efficient howling control system is desired to improve a user's hearing experience.

Existing howling control methods are mainly focused on two aspects: (1) prevention of loop feedback from the speaker to the microphone; and (2) reduction of the amplification gain to avoid the positive feedback of the system when the howling sound occurs. Only reducing the amplification gain is not efficient even if the howling detection is adaptive because when the amplification gain is recovered to the normal value, the problem remains. Thus, when no howling sound is detected, the personal amplifier system should be reset to a normally working status. However, as long as the loop back from the speaker to the microphone exists, the howling sound will occur again when the amplification gain is recovered, creating residual feedback. Therefore, howling detection alone cannot be relied upon to mitigate the howling sound, and the user can be physically required to prevent the loop back from the speaker to the microphone.

A novel technique is proposed wherein the device can adaptively adjust the user's own voice signal to the same level of the source signals. Consequently, even after amplification by the device, the loudness of the user's own voice will be the same as far-end sources. The signal captured by the microphone can be statistically analyzed. The statistically analyzed signal can then be classified into a few classes such as very small, small, medium, large, and very large. If the signal is classified as small or medium, then the signal can be likely to be signal from the source of interest, which is far from the microphone. A signal that is classified as large or very large can be likely to be a signal from the user because the user is much closer to the microphone. The system can then adaptively reduce the amplitude of the larger signals to the same level as the small or medium level signals. Thus, the user's own voice can be perceived to be of equal loudness to the far end signal and will not be too loud for his/her auditory system.

In one non-limiting embodiment, the absolute amplitude of the signals captured by a microphone of a hearing assistive device or hearing aid device can be statistically analyzed. These signals can comprise a speech signal from multiple far-end talkers, environmental noise, and/or the user's own speech signals. The absolute amplitude level of the captured signals are statistically analyzed and classified into classes. The absolute amplitude range for each class can be empirically estimated. For example, in a quiet environment, the amplitude of a very small signal can range from 100 to 1000 counts; the amplitude can range from 1000 to 5000 counts for a small signal; the amplitude of a medium signal can range from 5000 to 10000 counts; and for a large signal, the amplitude can range from 10000 to 20000 counts and for a very large signal, the amplitude can be more than 20000 counts. The count number can be based on or related to a 16 bit quantize.

As mentioned, the absolute amplitude of the microphone-captured signal can be statistically analyzed. An adaptive statistical signal processing technique can be developed. Briefly, for a 16 bit signal, the maximum amplitude can be 32768 counts. The maximum amplitude can be divided equally into 100 bins, so each bin will be 327.68 counts linearly increased to its maximum count of 32768. For example, the first bin can be sitting on 327.68 and the second bin can be sitting on 2*327.68=655.36, and so on. So if the sample has an amplitude of 491.52 (327.68+163.84) or less will be sorted into the first bin. If the sample has an amplitude larger than 491.52 but less than or equal to 819.2 (655.36+163.84), it will be sorted into this second bin, and so on and so forth.

Therefore, the probability density of each bin can be computed. The probability density for the bin for each of the four ranges in this case is compute recursively as follows. The bin that corresponds to the amplitude of the signal at time t is added a count $\alpha$. The rest of the bins will be reduced by the quantity $P_m*(1-\alpha)$, where m is the bin number which ranges from 1 to M, where M is the total number of bins. $P_m$ is the probability density of bin m. This process is further illustrated by the equations below:

$$Bin=[B_1B_2B_3 \ldots B_M], \quad \text{Equation (1):}$$

wherein, the largest amplitude of a block can belong to bin $B_{13}$, in this case:

$$P_{m,t}=P_{m,t-1}*(1-\alpha), \quad \text{Equation (2):}$$

for m=1, 2, . . . M at time instant t $$P_{13,t}=P_{13,t-1}+\alpha, \quad \text{Equation (3):}$$

where $P_m$ is the probability density of bin m, and $P_{13}$ is probability density of bin 13. Whereas the bin number m ranges from 1, 2, 3 . . . M, excluding m=13 in this case, then $P_{13,t-1}$ is the probability density of bin $B_{13}$ at time frame t−1. Therefore, the sum of the probability of all the bins will be equal to one:

$$\Sigma_{m=1}^{M} P_{m,t}=1, \text{ where } m=1,2,3 \ldots M, \text{ at time frame } t. \quad \text{Equation (4)}$$

A probability table can also be formed from the bin data. The probability table can be updated continuously for efficacy, as the device perceives various signals, because the signal environment will keep changing as the user moves from one location to another or the acoustic environment changes. The time constant for updating the probability density table can be empirically determined.

The bin with the higher probability from 1000 to 10000 is taken to be the amplitude of the sources, e.g., the speech signal(s) from far-end talkers. The bin with the higher probability from 10000 up to 32768 is deemed to be the user speech. The bin with the highest probability below 1000 is likely to be noise amplitude.

A dynamic range controller can adaptively limit the captured signals absolute amplitude levels. The absolute amplitude level is the level derived from the probability density table. The bin with the highest probability in the range from 1000 to 10000 can be deemed to be the level for the far-end talkers. Therefore, the far-end signal amplitude will not be affected by the controller, whereas the near-end signal amplitude (e.g.: the user speech amplitude) is expected to be much larger than 10000 and will be limited by the controller to the same amplitude as the far-end signal. In this way, the loudness of the user's own voice will be the same as the far-end voice from the talkers, yielding a desirable end result.

In addition, in other non-limiting embodiments, an integrated personal amplifier system can comprise acoustic feedback control to significantly improve the hearing experience. As mentioned, in personal amplifier system, the acoustic feedback can occur when there is a loop back from the speaker to the microphone. Traditional feedback/howling control systems find it difficult to recover from feedback control mode to a normal working mode. In a proposed system, an interaction between the device and the user can ensure that the feedback control system is working more efficiently.

A feedback detector can be employed after the amplifier. When the feedback occurs and is detected, the feedback detector can mute the speaker by setting the amplification gain to zero to protect the hearing and provide a warning signal by a status indicator to inform the user that the system is in a feedback protection mode. The status indicator can be a light emitting diode (LED), an audible tone, etc. After the user realizes that the feedback is occurring so that the feedback protection mode is activated, the user can verify the cause of the loop back from the speaker to the microphone. For example, the user may not have sealed the earbud into the ear canal properly, or the speaker might be placed too close to the microphone. Once the user verifies the cause, the system can recover/revert to the normal working mode in response to a user interaction with the system.

In order to make the feedback detection more accurate and reliable, a filter bank can be applied to the personal amplifier system. In each channel of the filter, there can be a feedback detector working independently; and once a feedback is detected in any frequency band, the system can go into the feedback protection mode.

According to one embodiment, described herein is a method for facilitating feedback reduction in assistive hearing devices. The method can comprise sampling, a block of sound data associated with acoustic signal samples of acoustic signals can be sampled, and generating data related to an absolute amplitude of the acoustic signal samples. Furthermore, the method can extract sample data related to a sample of the acoustic signal samples, and sort the sample data into predetermined absolute amplitude ranges.

According to another embodiment, described herein is another method for feedback reduction. The method can comprise receiving signal data related to an acoustic signal, and in response to the receiving the signal data, analyzing the signal data. The signal data can also be classified into classes, and an acoustic feedback can be detected, resulting in an acoustic feedback detection. Consequently, a channel can be muted in response to the acoustic feedback detection.

According to yet another embodiment, described herein is an apparatus for facilitating feedback reduction. The apparatus can comprise a microphone that receives first acoustic signal data related to a first acoustic signal, and an amplifier that amplifies the acoustic signal. The apparatus can also comprise an acoustic feedback detector that detects acoustic feedback signal data, and a speaker that outputs a second acoustic signal These and other embodiments or implementations are described in more detail below with reference to the drawings.

FIGS. 1-11 illustrate apparatuses and methods that facilitate production of hearing aid devices with reduced acoustic feedback. For simplicity of explanation, the methods (or algorithms) are depicted and described as a series of acts. It is to be understood and appreciated that the various embodiments are not limited by the acts illustrated and/or by the order of acts. For example, acts can occur in various orders and/or concurrently, and with other acts not presented or described herein. Furthermore, not all illustrated acts may be required to implement the methods. In addition, the methods could alternatively be represented as a series of interrelated states via a state diagram or events. Additionally, the methods described hereafter are capable of being stored on an article of manufacture (e.g., a computer readable storage medium) to facilitate transporting and transferring such methodologies to computers. The term article of manufacture, as used herein, is intended to encompass a computer program accessible from any computer-readable device, carrier, or media, including a non-transitory computer readable storage medium.

Referring now to FIG. 1, illustrated is an example schematic of an assistive hearing device. The assistive hearing device, also known as a hearing aid can comprise a microphone 100, an amplifier 102 and one or more speakers 104. Whenever the aforementioned components are present, there is a potential for feedback. Feedback can occur when the sound from the speaker 104 makes it back into the microphone 100 and is re-amplified and sent through the speaker 104 again. This loop can happen quickly enough to produce its own frequency, which can be heard as a howling sound. The howling sound is generally a sinusoidal wave tone, and the distance between the microphone 100 and the speaker 104 can contribute to the frequency of the howling because that distance dictates how quickly the sound can propagate through the system. After amplified for so many times, the howling sound can be so loud that it irritates or damages a user's hearing. Moreover, the amplification gain can be high in a hearing aid device, and thus the howling sound is very common. Therefore, an efficient howling control system is desired to improve people's hearing experience.

Figure 2:
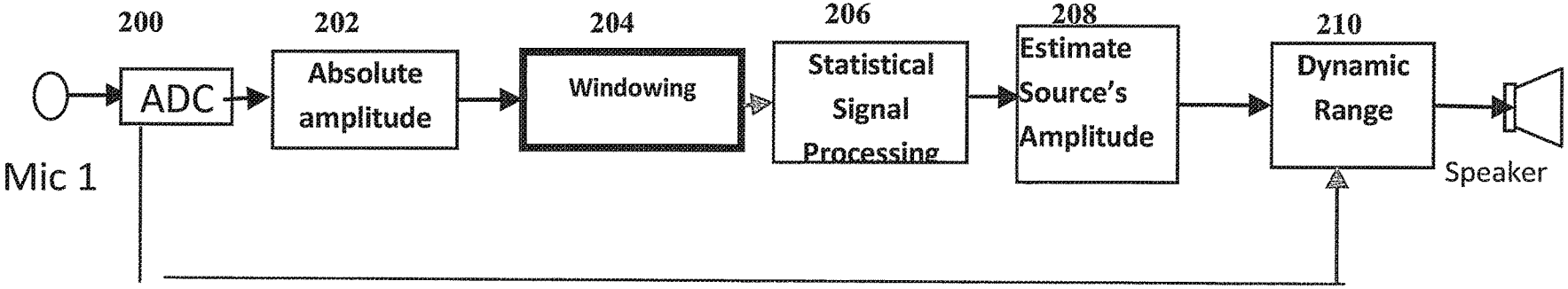
FIG. 2 illustrates an example schematic system block diagram of an assistive hearing device.

Referring now to FIG. 2, illustrated is an example schematic system block diagram of an assistive hearing device. After the analog-to-digital converter (ADC) 200 pre-processes and acoustic signals and removes the digital conversion (DC), if necessary, the DC removed input signal of the microphone can be converted to an absolute amplitude 202 value. The absolute amplitude 202 signal can be windowed, by a windowing process 204, into a block of N samples. The block of N samples can be processed by a statistical signal processor. During the statistical signal processing 206, the signal with the largest amplitude can be selected from the block. An estimate source amplitude 208 can correspond to the largest amplitude and can be added at count $\alpha$, the rest of the bins can be reduced by the quantity $P_m*(1-\alpha)$, where m is the bin number and M is the total number of bin. The dynamic range 210 controller can constrain the amplitude of all signals to be not more than the amplitude of a far-end signal. In this way, any howling if it happens, will be severely limited.

For example if the sample amplitude is sorting into one of four ranges with more than 5000 counts but less than 10000 counts, it can sort into range 3. If the signal amplitude is less than 5000 but larger than 1500, it can be place into range 2 and so on and so for. The signal sample can be further sorted into one of the 100 bins in range 3 to form a probability table.

Figure 3:
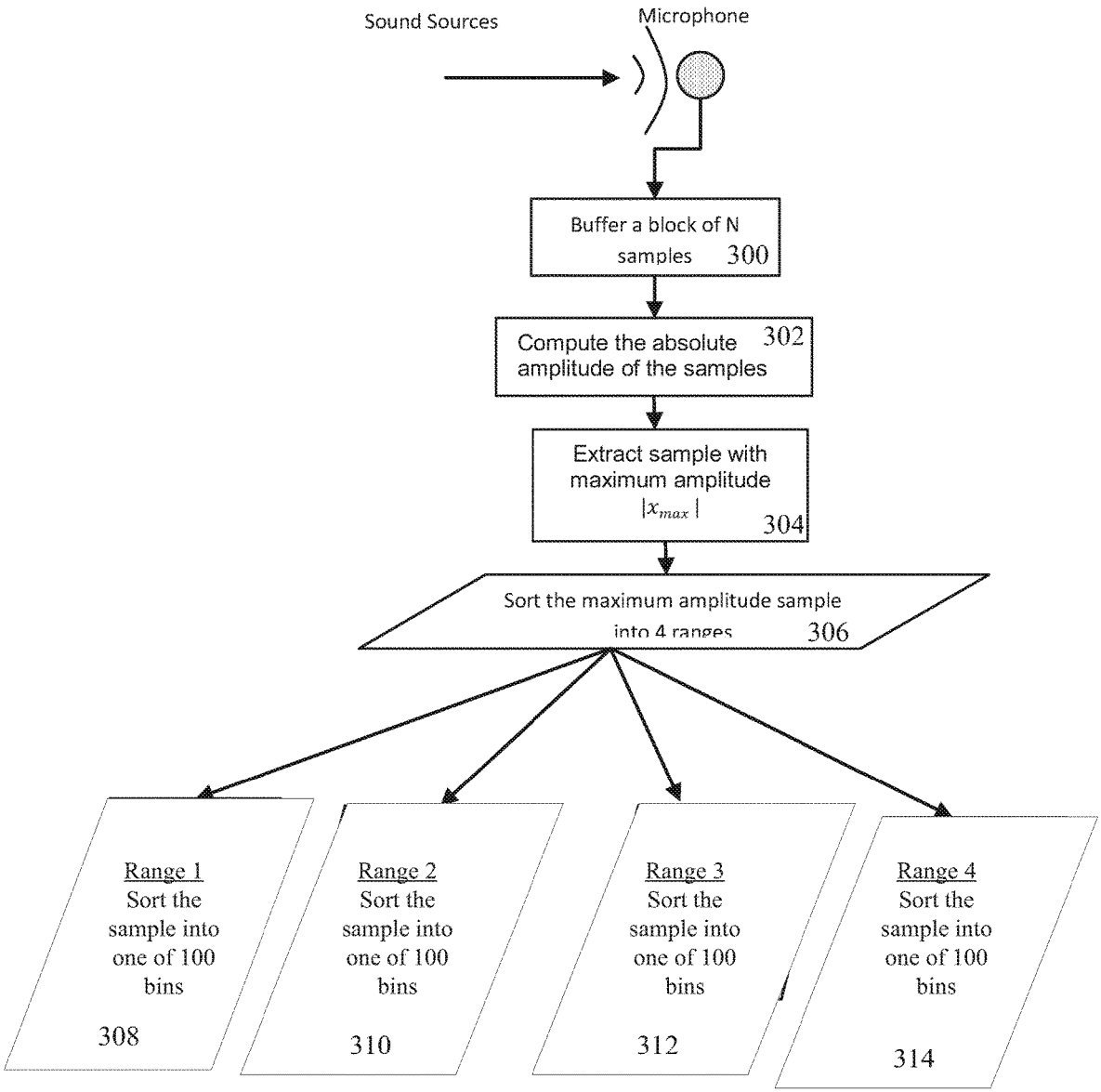
FIG. 3 illustrates an example schematic system block diagram of an assistive hearing device comprising a statistical processor.

Referring now to FIG. 3, illustrated is an example schematic system block diagram of an assistive hearing device comprising a statistical processor. The statistical signal processing 206 can comprise buffering a block of N samples at element 300. At element 302, the statistical signal processing 206 can compute the absolute amplitude of the N samples. The system can extract a sample with a maximum amplitude at 304, and sort the maximum amplitude into four ranges at element 306. The four ranges can comprise sorting the sample into one of the 100 bins at elements 308, 310, 312, 314.

Figure 4:
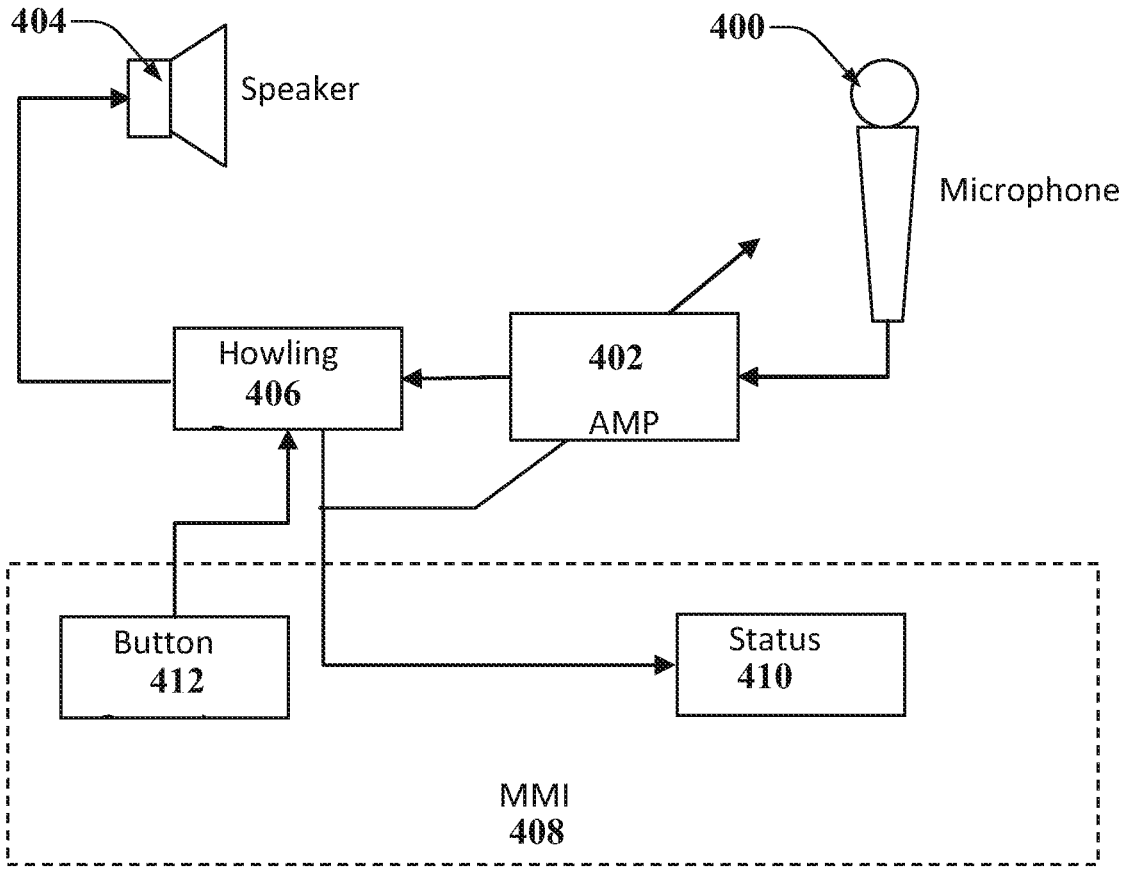
FIG. 4 illustrates an example schematic of an assistive hearing device comprising a howling control system.

Referring now to FIG. 4, illustrated is an example schematic of an assistive hearing device comprising a howling control system. The hearing device can comprise a microphone 400, an amp 402, a howling detector 406, and a speaker 404. The howling detector 406 can comprise a man-to-machine interface (MMI) 408 comprising a button 412 to interact with a user and a status indicator 410. The howling detector 406 can be employed after the amplifier 402. When the howling sound occurs and is detected, the howling detector 406 can mute the speaker 400 by setting an amplification gain to zero to protect the user's hearing and provide a warning signal by status indicator 410 to inform the user that the system is in a howling protection mode. The status indicator 410 can be a light emitting diode (LED), audible tones, a display screen, etc. After the user realizes that the howling sound is occurring and the howling protection mode is activated, the user can verify a cause of the loop back from the speaker 404 to the microphone 400. For example, the user may not have sealed the ear bud into an ear canal properly, or the speaker 404 might be placed too close to the microphone 400. Once the user makes sure that the loop back from the speaker 404 to the microphone 400 will not happen, the user can reset the system to a normal working mode by interacting with the MMI 408.

Figure 5:
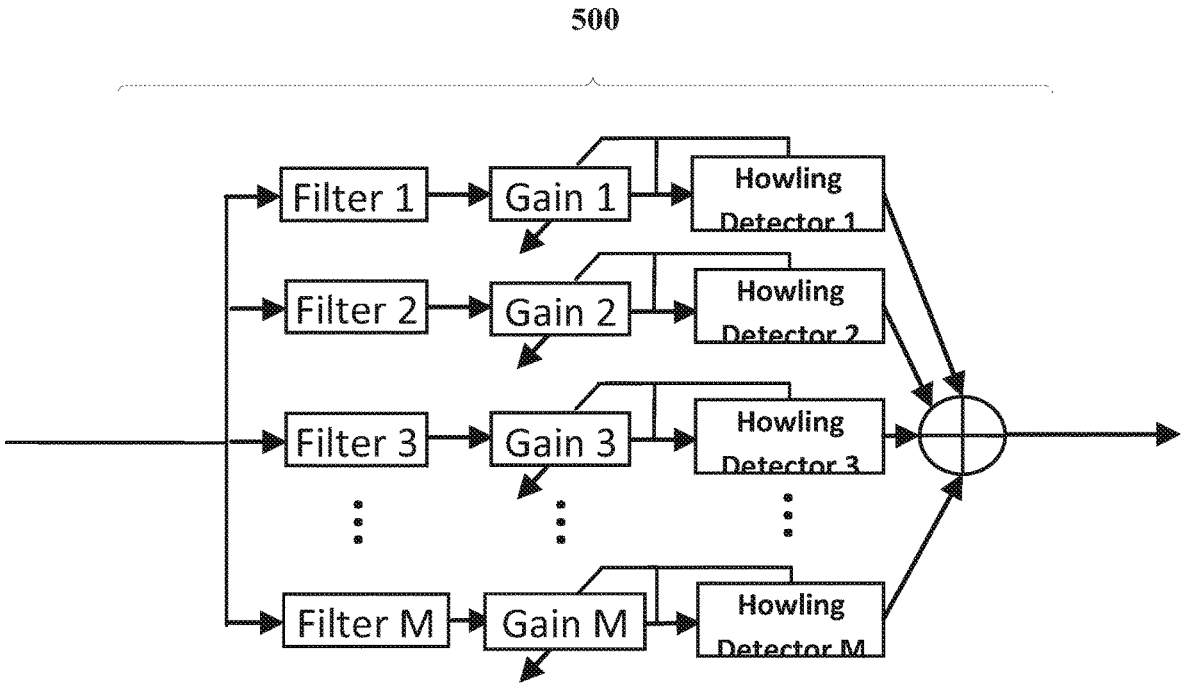
FIG. 5 illustrates an example schematic of a filter bank howling control system.

Referring now to FIG. 5, illustrated is an example schematic of a filter bank howling control system. A filter bank amplifier system 500 can be leveraged for more accuracy and flexibility when reducing the howling effect. The filter bank amplifier system 500 can filter the input signal into M different frequency bands. In each channel, an amplification and a howling detection can be performed separately. Since the howling sounds at different frequencies have different properties, it is more accurate to detect their occurrence in different frequency bands. Once a howling sound is detected in any frequency band, all the amplification gains such as Gain1, Gain2, . . . , Gain M will can be set to zero to mute the overall output signal. When the frequency band where the howling sound occurs is muted, the howling sound can shift to other frequency bands. Therefore, in one embodiment, all the channels can be muted to prevent the howling sound from shifting to other frequency bands.

Figure 6:
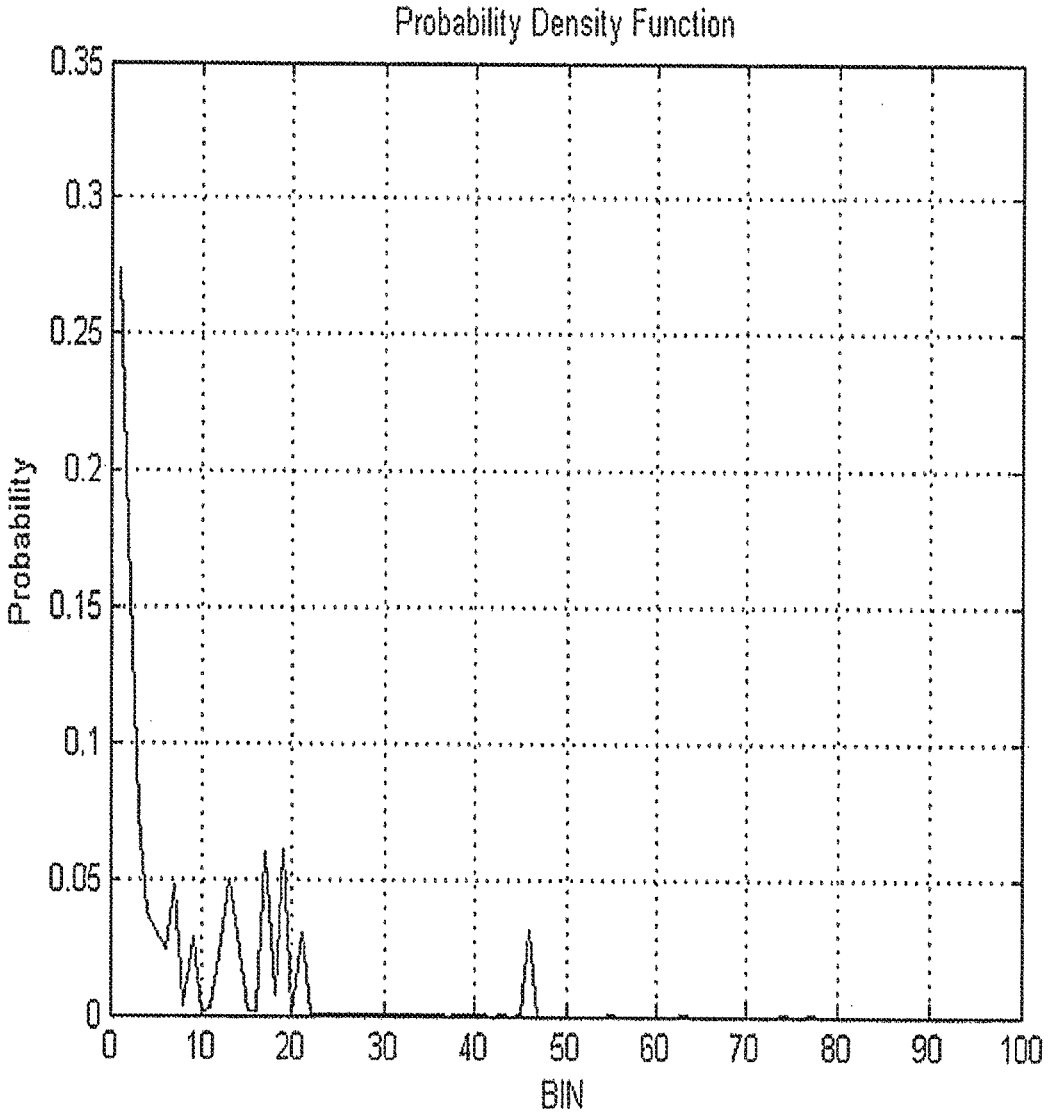
FIG. 6 illustrates an example schematic of a probability density function.
Figure 7:
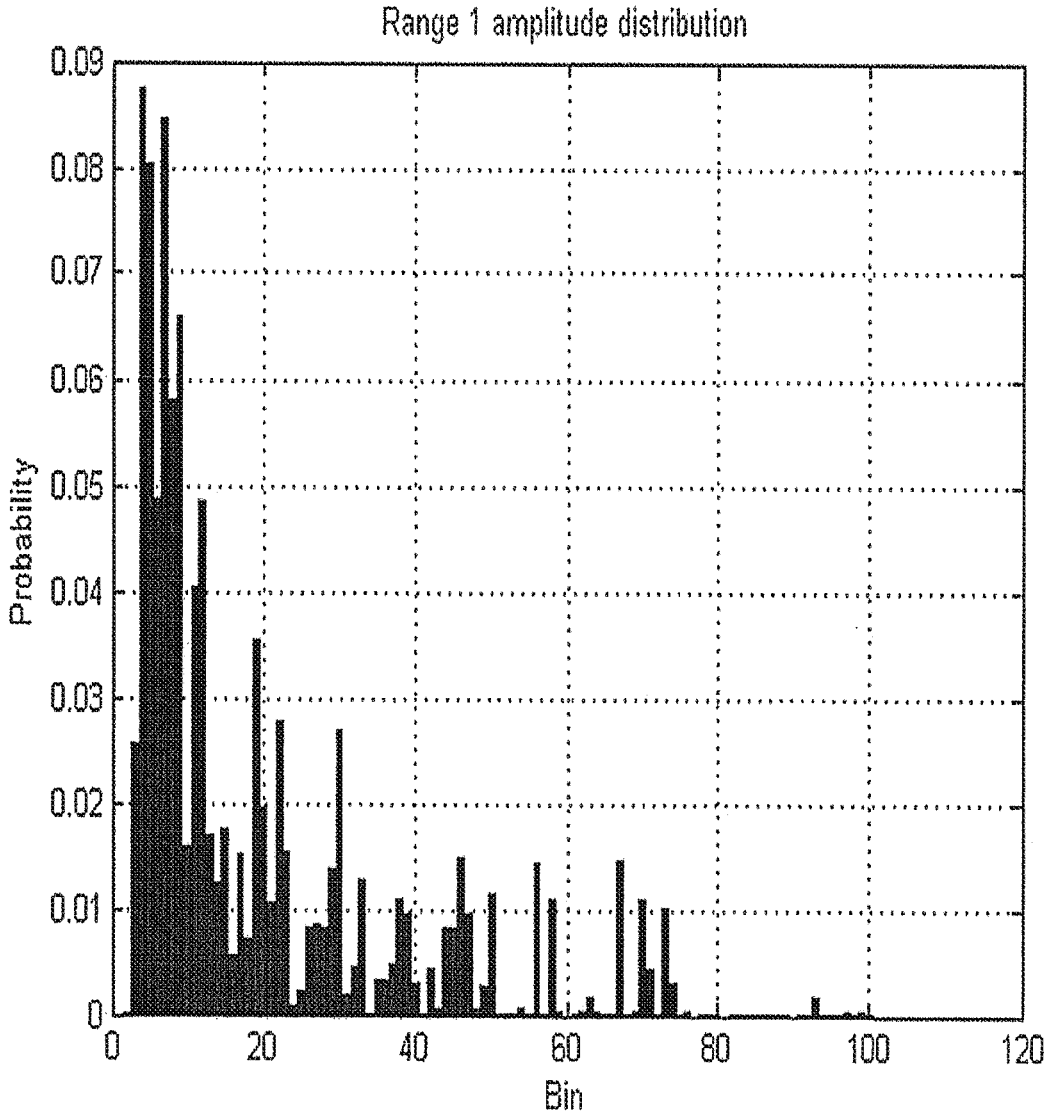
FIGS. 7-10 illustrate example schematics of probability density distributions over several ranges.
Figure 8:
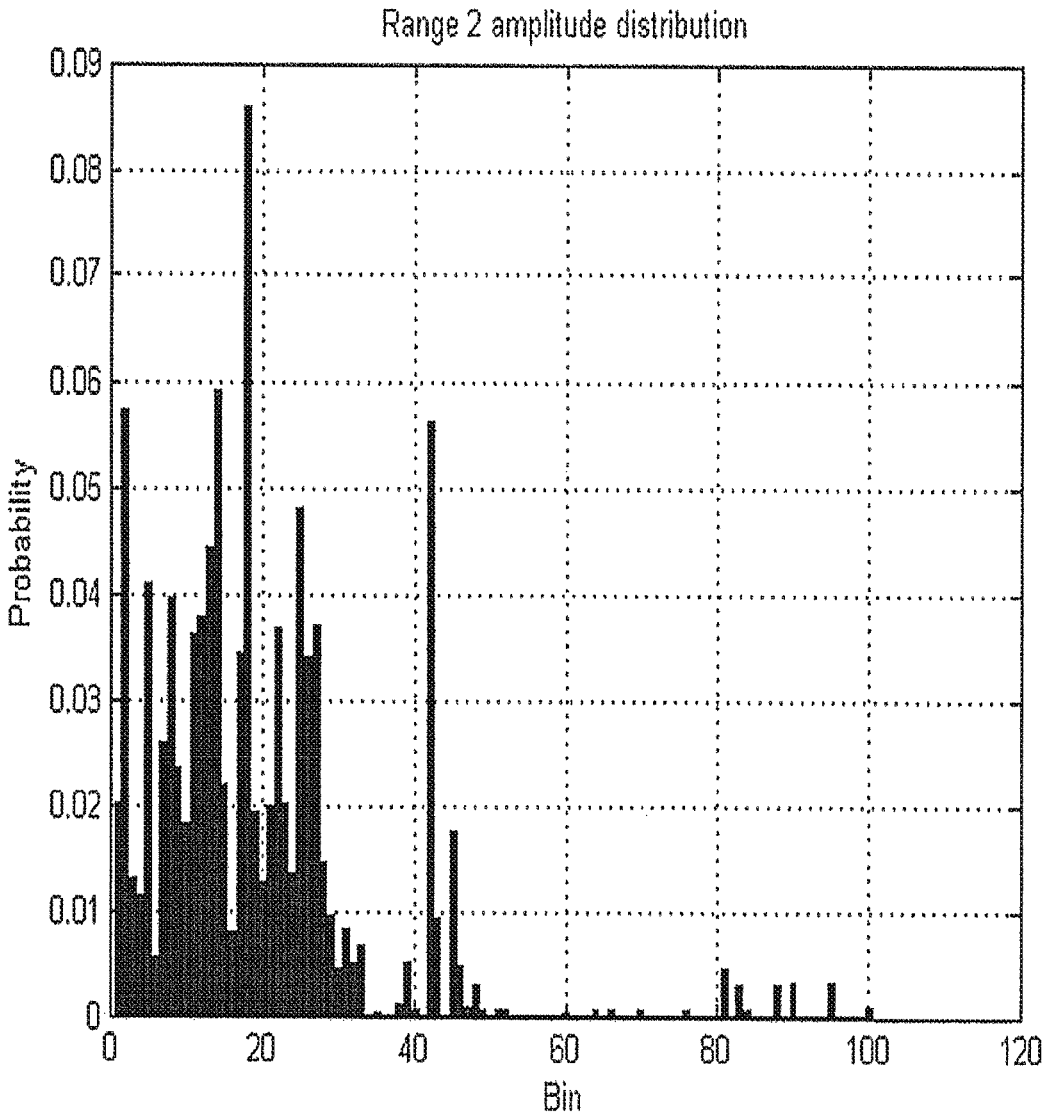

Referring now to FIG. 6, illustrated is an example schematic of a probability density function. A bin number can be empirically set to 16 or below for environmental noise amplitude distribution, where bin one can have the highest probability because noise is present all the time during any conversation. It can be dominated by an amplitude typically below 327.68 counts for a 16 bit ADC. The far-end signal or the sources can typically be dominated by bin numbers 16 to 31, which can also be empirically determined. The highest probability is bin number 19, which can correspond to an amplitude of about 6226 counts on a 16 bit scale. The range for bin 32 and up can correspond to near end talkers or a user's own voice. The bin with the highest probability in this range is bin 46. In this case, the amplitude corresponding to this bin is 15073 counts. This amplitude is about 2.5 times larger than that of the far-end sources.

In order to minimize or to prevent the saturation of the far-end sources, the maximum amplitude of the dynamic range controller can be empirically set to be two bins above the bin with the highest probability. In this case, instead of the amplitude of 6226, the maximum amplitude of the dynamic range controller is set to 6881 counts.

The dynamic range controller can constrain the amplitude of all the signals to be less than or equal to the amplitude of a far-end signal. Thus, any howling can be limited.

Referring now to FIGS. 7-10, illustrated are example schematics of probability density distributions over several ranges. FIGS. 7-10 show the sample probability distribution for each of the four ranges. The probability distributions can vary over time and the rate of change can depend on a desired time constant.

Figure 9:
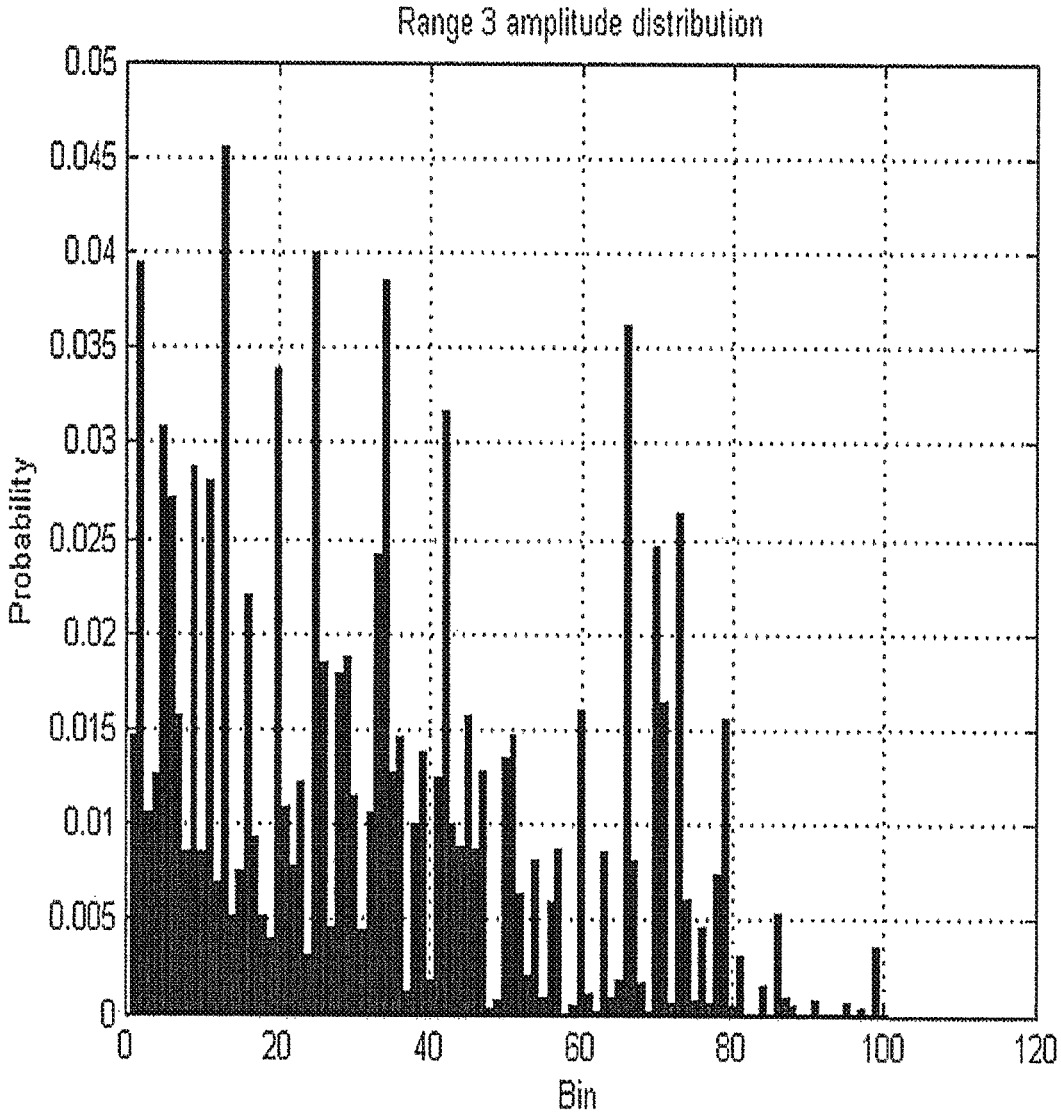
Figure 10:
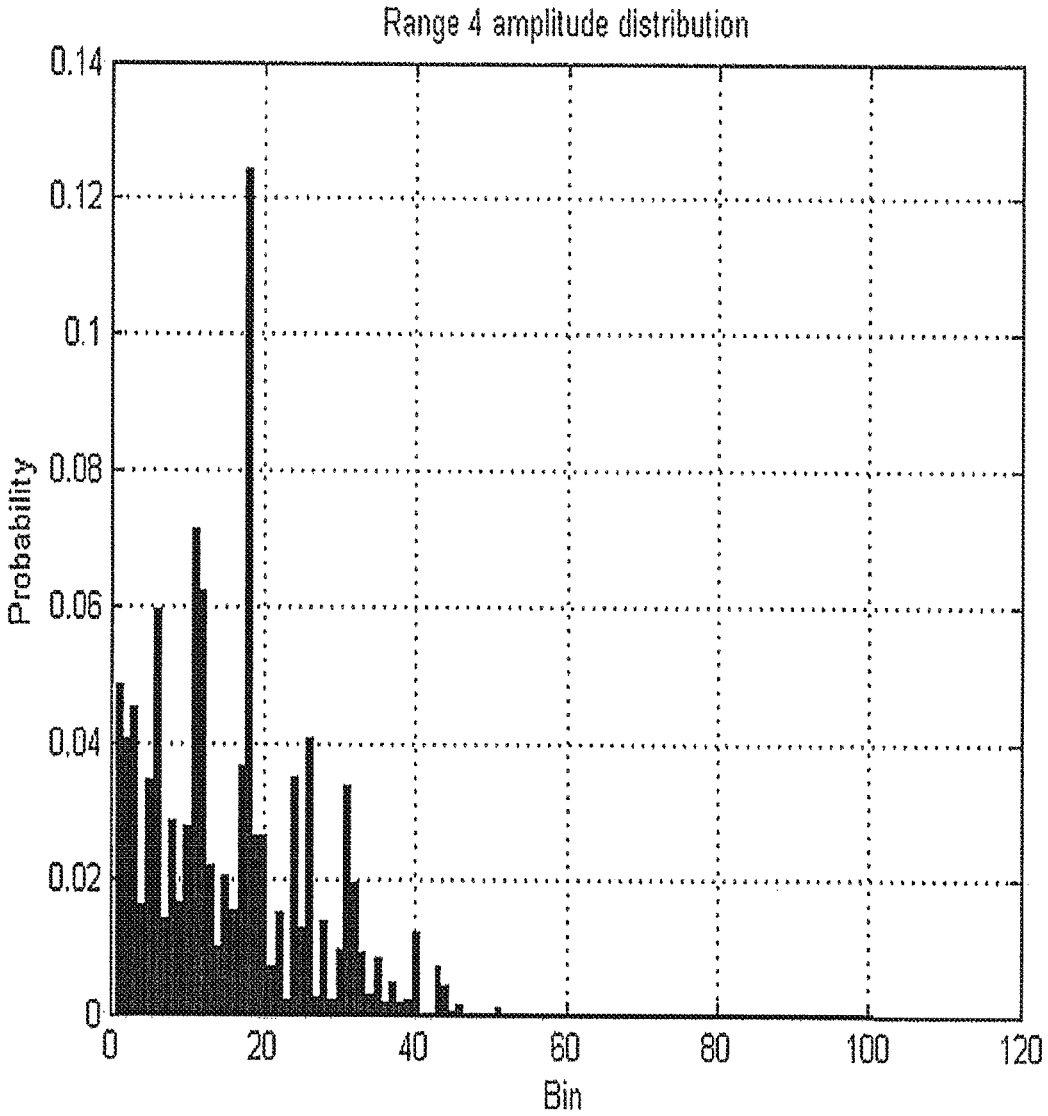

In order to ensure that the far-end signal is not saturated by the dynamic controller and it is also not too loud when the user speaks, the probability distribution density of Range 3 should be considered. Referring now to FIG. 9, the bin with the maximum probability is 15 and this bin corresponds to a signal amplitude of about 5735 counts. Therefore, the saturating threshold of the dynamic controller will be set to 5735 counts in this particular case. The dynamic range saturating threshold will change block to block slowing but will be within the range of 5,000 counts to 10,000 counts. Consequently, the dynamic range controller can constrain the amplitude to be less than or equal to the amplitude of a far-end signal.

Figure 11:
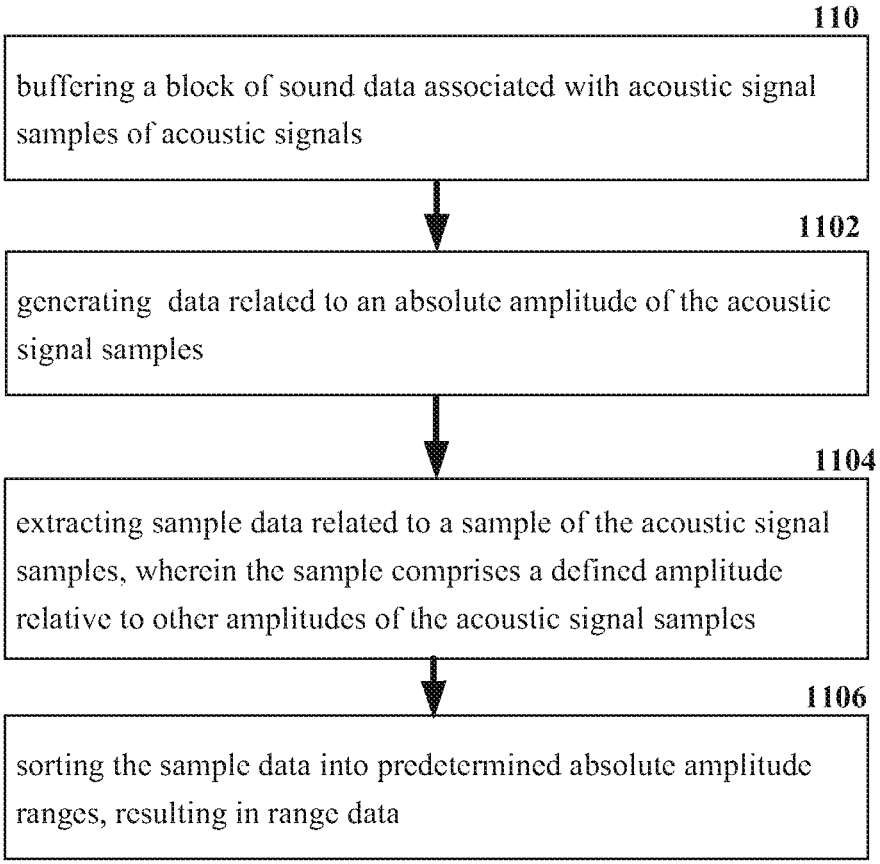
FIG. 11 illustrates an example schematic system block diagram of a method for reducing acoustic feedback.

Referring now to FIG. 11, illustrated is an example schematic system block diagram of a method for reducing acoustic feedback. At element 1100, a block of sound data associated with acoustic signal samples of acoustic signals can be sampled. At element 1102, data related to an absolute amplitude of the acoustic signal samples can be generated. Sample data related to a sample of the acoustic signal samples can be extracted at element 1104, wherein the sample comprises a defined amplitude relative to other amplitudes of the acoustic signal samples. Additionally, the sample data can be sorted into predetermined absolute amplitude ranges, resulting in range data, at element 1106.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the subject matter has been described herein in connection with various embodiments and corresponding FIGs, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A method, comprising:

buffering, by a hearing aid device comprising a processor, a block of sound data associated with acoustic signal samples of acoustic signals;

based on a value associated with an acoustic signal, of the acoustic signals, selecting, by the hearing aid device, the acoustic signal to estimate a source amplitude of the acoustic signal;

generating, by the hearing aid device, data related to an absolute amplitude of the acoustic signal samples;

based on the source amplitude of the acoustic signal, constraining, by the hearing aid device, an amplitude of an acoustic signal, to be output, to be less than the source amplitude of the acoustic signal, resulting in a constrained amplitude;

in response to the generating, partitioning, by the hearing aid device, the data related to the absolute amplitude into a defined number of the acoustic signal samples;

extracting, by the hearing aid device, sample data related to a sample of the defined number of the acoustic signal samples, wherein the sample comprises information representative of a defined amplitude relative to other amplitudes of the acoustic signal samples;

based on an estimated amplitude that corresponds to a threshold amplitude satisfying a criterion associated with the acoustic signal samples, sorting, by the hearing aid device, the sample data into predetermined absolute amplitude ranges, resulting in range data, wherein the range data comprises bin data associated with binning the range data;

in response to determining a probability density of the bin data, generating, by the hearing aid device, a data structure associated with the probability density of the bin data, wherein the generating the data structure is performed as function of a location of the hearing aid device; and in response to the constraining, outputting, by the hearing aid device, the acoustic signal in accordance with the constrained amplitude.

2. The method, of claim 1, wherein the predetermined absolute amplitude ranges are associated with a range estimation based on an estimation of the predetermined absolute amplitude ranges.

3. The method, of claim 1, wherein the value is a first value, and wherein the binning the range data comprises replacing a second value of the data with a third value representative of the predetermined absolute amplitude ranges.

4. The method of claim 3, further comprising:

determining, by the hearing aid device, the probability density of the bin data.

5. The method of claim 4, wherein the generating a data structure associated with the probability density of the bin data is performed recursively.

6. The method of claim 5, further comprising:

in response to recursively generating the data structure associated with the probability density of the bin data, updating, by the hearing aid device, the data structure.

7. The method of claim 5, further comprising:

in response to analyzing the data structure associated with the probability density of the bin data, further constraining, by the hearing aid device, the amplitude of the acoustic signal, to be output, to a same level of the threshold amplitude, resulting in a further constrained amplitude.

8. The method of claim 7, further comprising:

outputting, by the hearing aid device, the acoustic signal in accordance with the further constrained amplitude.

9. The method of claim 5, further comprising:

setting, by the hearing aid device, the threshold amplitude of an output acoustic signal, to be output, to a number of bins above a bin with a highest probability.

10. The method of claim 9, further comprising:

outputting, by the hearing aid device, the output acoustic signal in accordance with the setting the threshold amplitude of the output acoustic signal.

11. The method of claim 1, wherein the defined amplitude is related to a threshold distance associated with the acoustic signal samples.

12. A method, comprising:

receiving, by a hearing device comprising a processor, signal data related to acoustic signals;

based on a value associated with an acoustic signal, of the acoustic signals, selecting, by the hearing device, the acoustic signal;

in response to the receiving the signal data, analyzing, by the hearing device, the acoustic signals to estimate a source amplitude of the acoustic signal, resulting in an estimated source amplitude;

based on the estimated source amplitude of the acoustic signal, limiting, by the hearing device, an amplitude of an output acoustic signal to be equal to the estimated source amplitude of the acoustic signal, resulting in a limited amplitude;

in response to the analyzing, partitioning, by the hearing device, the acoustic signals into a defined number of the acoustic signal samples;

based on the analyzing, extracting, by the hearing device, sample data comprising a defined amplitude relative to the acoustic signal of the acoustic signals;

based on the estimated source amplitude and in response to the extracting, sorting, by the hearing device, the defined amplitude into a determined absolute amplitude range, wherein the determined absolute amplitude range comprises bin data associated with binning the determined absolute amplitude range;

in response to determining a probability density of the determined absolute amplitude range, generating, by the hearing device, a data structure associated with the probability density of the determined absolute amplitude range, wherein the generating the data structure is performed as function of a location of the hearing device; and in response to the generating the data structure, outputting, by the hearing device, the output acoustic signal in accordance with the limited amplitude.

13. The method of claim 12, further comprising:

in response to an acoustic feedback detection, generating, by the hearing device, a warning signal.

14. The method of claim 13, wherein the warning signal comprises a light emitting diode indicator.

15. The method of claim 13, wherein the warning signal comprises an acoustic tone.

16. The method of claim 12, further comprising:

muting, by the hearing device, a channel, wherein the muting the channel comprises setting an amplification gain to zero.

17. A method, comprising:

buffering, by a hearing device comprising a processor, a block of sound data associated with acoustic signal samples of acoustic signals;

based on a value associated with an acoustic signal, of the acoustic signals, selecting, by the hearing device, the acoustic signal to estimate a source amplitude of the acoustic signal, resulting in an estimated source amplitude;

based on the estimated source amplitude of the acoustic signal, constraining, by the hearing device, an amplitude of an output acoustic signal to be less than the estimated source amplitude of the acoustic signal, resulting in a constrained amplitude;

generating, by the hearing device, data related to an absolute amplitude of the acoustic signal samples;

in response to the generating, windowing, by the hearing device, the data related to the absolute amplitude into a defined number of the acoustic signal samples;

extracting, by the hearing device, sample data associated with a sample of the defined number of the acoustic signal samples, wherein the sample comprises information representative of a defined amplitude relative to other amplitudes of the acoustic signal samples; and based on an estimated amplitude value associated with the defined amplitude satisfying a threshold criterion of the other amplitudes associated with the acoustic signal samples, binning, by the hearing device, the sample data into predetermined absolute amplitude ranges, resulting in bin data;

in response to determining a probability density associated with the bin data, generating, by the hearing device, a data structure associated with the probability density of the bin data, wherein the generating the data structure is performed as function of a location of the hearing device in relation to an acoustic feedback signal; and in response to the generating the data structure, outputting, by the hearing device, the output acoustic signal in accordance with the constrained amplitude.

18. The method of claim 17, further comprising:

in response to receiving the block of sound data, detecting, by the hearing device, acoustic feedback signal data representative of the acoustic feedback signal.

19. The method of claim 18, wherein the acoustic feedback signal data is associated with channels of a filter bank of the hearing device.

20. The method of claim 17, further comprising:

controlling, by the hearing device, a first acoustic signal of the acoustic signals in accordance with a threshold value associated with a second acoustic signal of the acoustic signals.

* * * * *